US005090491A

United States Patent [19]

Tibbitts et al.

[11] Patent Number: 5,090,491

[45] Date of Patent: Feb. 25, 1992

[54] EARTH BORING DRILL BIT WITH MATRIX DISPLACING MATERIAL

[75] Inventors: Gordon A. Tibbitts, Salt Lake City; Ralph M. Horton, Murray; Lorenzo G. Lovato, Salt Lake City, all of Utah

[73] Assignee: Eastman Christensen Company, Salt Lake City, Utah

[21] Appl. No.: 665,918

[22] Filed: Mar. 4, 1991

Related U.S. Application Data

[63] Continuation of Ser. No. 408,476, Sep. 15, 1989, abandoned, which is a continuation of Ser. No. 107,945, Oct. 13, 1987, abandoned.

[51] Int. Cl.[5] ..... E21B 10/00

[52] U.S. Cl. ..... 175/409; 175/410

[58] Field of Search ..... 175/329, 409–411; 76/101 R, 101 E, 108 R, 108 A

[56] References Cited

U.S. PATENT DOCUMENTS

| | | | |
|---|---|---|---|
| 3,471,921 | 10/1969 | Feenstra | 29/473.1 |
| 3,757,878 | 9/1973 | Wilder et al. | 175/409 X |
| 3,757,879 | 9/1973 | Wilder et al. | 175/329 |
| 3,885,637 | 5/1975 | Veprintsev et al. | 175/329 |
| 4,173,457 | 11/1979 | Smith | 175/409 X |
| 4,244,432 | 1/1981 | Rowley et al. | 175/329 |
| 4,398,953 | 8/1983 | Drake | 76/108 A X |
| 4,460,053 | 7/1984 | Jurgens et al. | 175/329 |
| 4,484,644 | 11/1984 | Cook et al. | 175/410 |
| 4,527,642 | 7/1985 | Knowlton et al. | 175/329 |
| 4,610,320 | 9/1986 | Beakley | 175/409 |
| 4,624,830 | 11/1986 | Barr | 175/329 X |
| 4,720,371 | 1/1988 | Shirley | 419/10 |

FOREIGN PATENT DOCUMENTS

| | | |
|---|---|---|
| 0096591 | 12/1983 | European Pat. Off. . |
| 0145421 | 6/1985 | European Pat. Off. . |
| 1572543 | 7/1980 | United Kingdom . |
| 2151282 | 7/1985 | United Kingdom . |

OTHER PUBLICATIONS

Metals Handbook, Ninth Ed., vol. 7, "Powder Metallurgy", pp. 551-566 (1984).

Popov, E. P., *Mechanics of Materials,* (second edition), Prentice-Hall, Inc., Englewood, N.J., 1976, pp. 525-527.

*Primary Examiner*—Thuy M. Bui

*Attorney, Agent, or Firm*—Trask, Britt & Rossa

[57] ABSTRACT

A rotary drill bit for drilling earth formations is provided and includes a bit shank, a hard metal matrix secured to a blank and cutting elements on the exterior face thereof. The matrix includes a displacement material having a different composition than the matrix material within the matrix. The displacement material is preferably less expensive than the matrix material and also has different material properties. The resulting bit may be custom-engineered for toughness, ductility, and impact resistance.

15 Claims, 2 Drawing Sheets

EARTH BORING DRILL BIT WITH MATRIX DISPLACING MATERIAL

This application is a continuation of application Ser. No. 07/408,476, now abandoned, which was a continuation of application Ser. No. 07/107,945 filed Oct. 13, 1987, abandoned.

BACKGROUND OF THE INVENTION

This invention relates to drill bits, and more particularly to drill bits with diamond cutters used in the rotary drilling of bore holes in earth formations.

Typically, earth boring drill bits include an integral bit body which may be of steel or may be fabricated of a hard matrix material such as tungsten carbide. A plurality of diamond cutter devices are mounted along the exterior face of the bit body. Each diamond cutter typically has a stud portion which is mounted in a recess in the exterior face of the bit body. Depending upon the design of the bit body and the type of diamonds used (i.e., either natural or synthetic), the cutters are either positioned in a mold prior to formation of the bit body or are secured to the bit body after fabrication.

The cutting elements are positioned along the leading edges of the bit body so that as the bit body is rotated in its intended direction of use, the cutting elements engage and drill the earth formation. In use, tremendous forces are exerted on the cutting elements, particularly in the forward to rear direction. Additionally, the bit and cutting elements are subjected to substantial abrasive forces. In some instances, impact, lateral and/or abrasive forces have caused drill bit failure and cutter loss.

While steel body bits have toughness and ductility properties which render them resistant to cracking and failure due to impact forces generated during drilling, steel is subject to rapid erosion due to abrasive forces, such as high velocity drilling fluids, during drilling. Generally, such steel body bits are coated with a more erosion resistant material such as tungsten carbide to improve their erosion resistance. However, tungsten carbide and other erosion resistant materials are brittle. During use, the relatively thin coatings may crack and peel, revealing the softer steel body which is then rapidly eroded. This leads to cutter loss, as the area around the cutter is eroded away, and eventual failure of the bit.

Tungsten carbide or other hard metal matrix bits have the advantage of high erosion resistance. The matrix bit is generally formed by packing a graphite mold with tungsten carbide powder and then infiltrating the powder with a molten copper alloy binder. A steel blank is present in the mold and becomes secured to the matrix. The end of the blank can then be welded or otherwise secured to an upper threaded body portion of the bit.

Such tungsten carbide or other hard metal matrix bits, however, are brittle and can crack upon being subjected to impact forces encountered during drilling. Additionally, thermal stresses from the heat generated during fabrication of the bit or during drilling may cause cracks to form. Typically, such cracks occur where the cutter elements have been secured to the matrix body. If the cutter elements are sheared from the drill bit body, the expensive diamonds on the cutter elements are lost, and the bit may cease to drill. Additionally, tungsten carbide is very expensive in comparison with steel as a material of fabrication.

Accordingly, there is a need in the art for a drill bit which has the toughness, ductility, and impact strength of steel and the hardness and erosion resistance of tungsten carbide or other hard metal on the exterior surface, but without the problems of prior art steel body and hard metal matrix body bits. There is also a need in the art for an erosion resistant bit with a lower total cost.

SUMMARY OF THE INVENTION

The present invention meets those needs by providing a rotary drill bit in which at least a portion of the hard metal matrix is replaced by a displacement material which, preferably, imparts a greater degree of toughness, ductility, and impact strength to the bit. The resulting bit may be custom-engineered to possess optimal characteristics for specific earth formations. According to one aspect of the present invention, a rotary drill bit is provided which includes a bit blank with a hard metal matrix secured to the blank. Within the matrix is a displacement material having a different composition than the matrix. Cutting elements are positioned on the exterior face of the matrix.

The displacement material is preferably in the form of a plurality of particles which can vary in size. Iron and steel particles are especially preferred because it has been found that these particles impart desirable properties to the matrix while being relatively inexpensive in comparison to the cost of the tungsten carbide or other hard metal component of the matrix. Particles as small as about 400 mesh (approx. 0.001 inches) or as large as 0.25 inches or larger may be utilized. Spherical or generally spherical particles are preferred because they will pack into a mold readily, although irregularly shaped particles may be employed.

Other displacement materials which can be used in the practice of the present invention include other ferrous alloys such as iron-molybdenum and iron-nickel which impart increased toughness and ductility to the matrix. Other metals which may be used as displacement materials include nickel, cobalt, manganese, chromium, vanadium, and alloys and mixtures thereof. Sand, quartz, silica, ceramic materials, and plastic-coated minerals may also be utilized either in small particle sizes or agglomerated with binder to form larger particles. In practice, the displacement material may be any material which can withstand the 1000 degrees C or greater processing temperatures encountered during the bit fabrication process and which is compatible with the hard metal matrix material and binder. By withstanding the furnacing process it is meant that the displacement material may melt so long as it maintains its integrity, does not disperse in the matrix, and does not undergo excessive expansion or shrinking during the heating-/cooling cycle.

While the displacement material may be added in volumes as low as about 10% of total matrix volume to effect lesser changes in matrix characteristics, preferably, the displacement material is added in an amount of between about 50% to about 80% by volume of the total matrix volume. Use of different diameter spherical particles aids in obtaining optimum packing within the mold. By utilizing particles with both large and small diameters, the small diameter displacement material can pack into the interstices between the larger diameter material.

In an alternate embodiment of the invention, the displacement material completely replaces the hard metal matrix material except for a thin face layer of hard metal matrix. In accordance with this embodiment, a rotary drill bit is provided which comprises a bit blank and a bit body including a hard metal matrix face and a core of a metal powder consolidated with a binder. The core is bonded to the blank, and the bit body has cutting elements disposed on the exterior face of the hard metal matrix. The metal powder making up the core is selected from the group consisting of iron, steel, ferrous alloys, and mixtures thereof. The binder is preferably a copper-based alloy.

With the practice of the present invention, a less expensive displacement material may be substituted for more expensive hard metals like tungsten carbide with no adverse affect on the strength properties of the finished bit. In fact, use of iron, steel, or alloys thereof as the displacement material provides a finished bit with improved toughness and ductility as well as impact strength. Futhermore, the use of such displacement materials can reduce the blank material required while maintaining desired levels of toughness, ductility, and impact strength.

Accordingly, it is an object of the present invention to provide a rotary drill bit in which less expensive material can be used to replace the more expensive hard metal matrix and blank materials to provide a more economical bit. It is a further object of the present invention to provide a rotary drill bit having improved ductility, toughness, and impact strength over prior hard metal matrix bits. These, and other objects and advantages of the present invention, will become apparent from the following detailed description, the accompanying drawings, and the appended claims.

DESCRIPTION OF THE PREFERRED EMBODIMENTS

Figure 2:
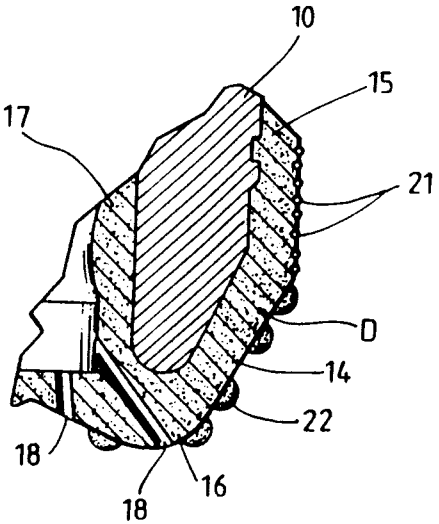
FIG. 2 is a view, similar to FIG. 1 of another embodiment of the invention.

The invention is illustrated in the drawings with reference to a typical construction of a rotary earth boring bit. It will be recognized by those skilled in this art that the configuration of the cutting elements along the exterior face of the matrix may be varied depending upon the desired end use of the bit. Additionally, while the invention has been illustrated in conjunction with a full bore rotary matrix bit, it will be appreciated by those skilled in this art that the invention is also applicable to core head type bits for taking core samples of an earth formation.

Figure 1:
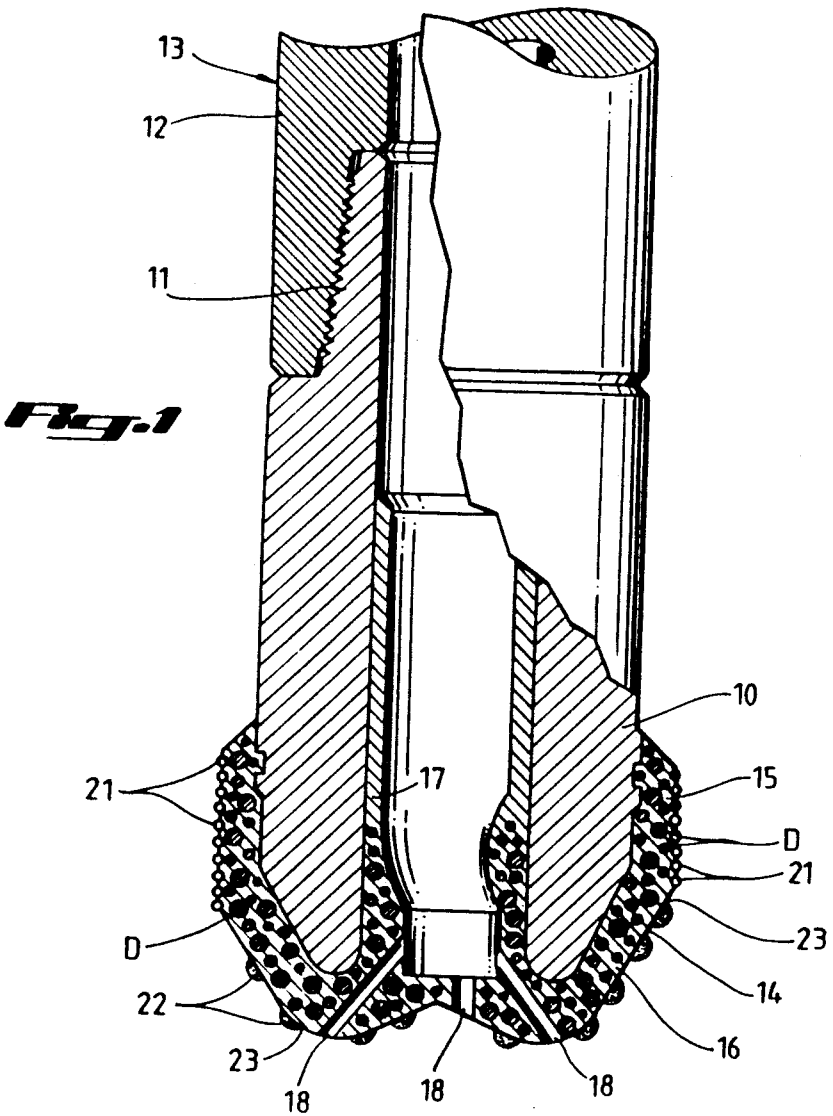
FIG. 1 is a view, partly in elevation and partly in section, of a rotary bit made in accordance with the present invention.

Referring now to FIG. 1, the rotary drill bit includes a tubular steel blank 10 welded to an upper pin 11 (weld line not shown) threadedly secured to a companion box 12 forming the lower end of a drill string 13. A matrix crown of hard metal matrix material 14, such as metal bonded tungsten carbide, has an upper gauge section 15 which merges into a face portion 16 extending across the tubular blank 10, which is integral with an inner portion 17 disposed within the tubular blank. Displacement material D is shown in the form of relatively large diameter spherical particles interspersed throughout the matrix. It will be understood that displacement material D can assume a variety of forms including both solid and hollow spheres, cylinders, lengths of wire, as well as irregular shapes.

As is conventional, fluid pumped downwardly through the drill string and into the tubular blank can flow into the inner matrix portion 17, discharging through a plurality of nozzles or orifices 18 into the bottom of the bore hole. This fluid carries the cuttings from the drill bit in a laterally outward direction across the face of the bit and upwardly through a plurality of spaced vertical passages (not shown).

Such passages are conventionally located in the gauge section and convey the cuttings and fluid into the annulus surrounding the tubular blank 10 and the drill string 13 and from there to the top of the bore hole. A number of fluid passages are of an enlarged size to function as junk slots through which upward flow of the drilling fluid and cuttings can occur more readily. Such fluid passages are conventional in the art. Diamonds 21 may be optionally embedded in the stabilizer section 15 to reduce wear on the latter section of the matrix.

Cutting elements 22 are disposed in sockets 23 in matrix 14 and may be arranged in any desired conventional pattern which will be effective to perform the cutting action. Depending upon the type of diamonds utilized, sockets 23 may be preformed in the matrix during fabrication. If sockets 23 are preformed, then cutting elements 22 may be mounted therein in a separate operation after forming the bit. On the other hand, if natural diamonds or polycrystalline synthetic diamonds which can withstand the processing temperatures encountered during fabrication are utilized, the diamonds may be positioned directly in the mold and secured thereto with a conventional adhesive prior to placement of the matrix material into the mold. This latter method eliminates the need for a separate step of mounting the cutting elements after molding.

The drilling fluid flows downwardly through the drilling string 13 into the inner portion 17 of the matrix bit crown 14, such fluid passing through nozzles 18 formed integrally in the matrix and discharging from the face of the bit against the bottom of the bore hole. The nozzles 18 may be circular or rectangular in cross-section. A rectangular cross-section causes the fluid discharged from each nozzle to sweep more broadly across the face of the bit and urge the cuttings toward the gauge portion 15 of the bit thereby cleaning and cooling the cutting elements 22.

Referring now to FIG. 2, where like reference numerals represent like elements, there is illustrated another embodiment of the invention. In this embodiment, displacement material D is in the form of a powder which is dispersed throughout the matrix 14. Preferably, the displacement material is at least 400 mesh (approx. 0.001 inches) in size. It has been found that very fine powdered materials (i.e., less than 0.001 inches in diameter) such as iron may sinter and shrink during fabrication.

It is undesirable for the powder to shrink substantially during heat processing. It is desirable that the binder substantially completely infiltrate the displacement material and consolidate the matrix and displacement material into a unitary solid mass. Particle sizes smaller than about 400 mesh may be utilized in lesser amounts in admixture with larger particles; this increases the packing efficiency of the particles.

Figure 3:
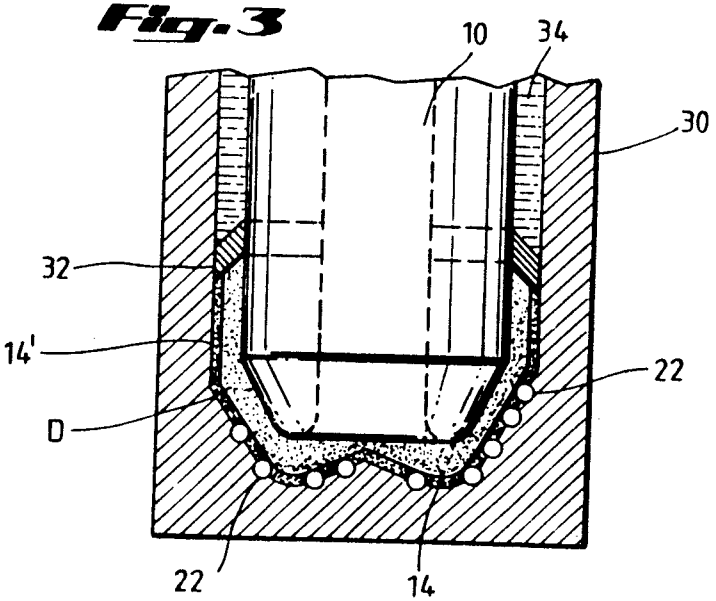
FIG. 3 is a sectional view of a mold for a rotary drill bit in accordance with the present invention, with the mold containing the various materials which are used to make up the finished bit.

FIG. 3 illustrates a preferred metallurgical process for fabricating the rotary drill bit of the present invention. A hollow mold 30 is provided in the configuration of the bit design. The mold 30 may be of any material, such as graphite, which will withstand the 1000 degrees C. and greater processing temperatures.

If natural diamond cutting elements or synthetic polycrystalline diamonds which can withstand the processing temperatures are utilized, they are conventionally located on the interior surface of the mold 30 prior to packing the mold. The cutting elements 21 (not shown) and 22 may be temporarily secured using conventional adhesives which vaporize during processing. During infiltration, the cutting elements will become secured in the matrix during the formation of the bit body.

Alternatively, if other types of cutting elements are used, the mold is shaped to produce preformed sockets in the matrix 14 to which the cutting elements may be secured after the bit body has been formed. These elements may be then secured by any conventional means such as hard soldering or brazing. Additionally, the cutting elements may be mounted on studs which fit into the sockets, and the studs secured therein.

Because of the high velocity and erosive fluids which may be typically encountered by rotary drill bits, a highly erosion resistant matrix material 14' may optionally be placed around the face of the mold. For example, the powdered materials from which matrix material 14' is formed may be applied to the mold as a "wet mix". This is a composition of the powdered material in a carrier such as a liquid hydrocarbon which vaporizes during high temperature processing. The wet mix may be packed along the sides and bottom of the mold and remain in place. Matrix material 14' may be of the same hard metal material such as tungsten carbide as matrix 14. As is known in the art, the powder grain size distribution of matrix material 14' may be varied to increase the skeletal density of the material, and thus increase its hardness and erosion resistance.

After optional matrix material 14' has been placed around the face of the mold, steel blank 10 is partially lowered into mold 30 as shown. As is conventional, elements which will form the internal fluid passages and nozzles in the finished bit are also positioned in mold 30 at this time. Then displacement material D is added. The displacement material may be any material which is different in composition than matrix material 14 and which can resist the high processing temperatures encountered. Preferably, the displacement material is less expensive than matrix material 14 and also is tougher and more ductile (less brittle) than the hard metal compounds used as matrix 14. Additionally, displacement material D should be compatible with the matrix material and binder.

In a preferred embodiment, displacement material D is selected from the group consisting of iron, steel, ferrous alloys, nickel, cobalt, manganese, chromium, vanadium, and metal alloys thereof, sand, quartz, silica, ceramic materials, plastic-coated minerals, and mixtures thereof. The displacement material is preferably in the form of discrete particles, and most preferably is in the form of generally spherical particles. Such spherical particles are easier to pack into the mold. Particle sizes may vary greatly from about 400 mesh (approx. 0.001 inches) to about 0.25 inches in diameter. Particles smaller than 400 mesh are not preferred because they tend to sinter to themselves and shrink during heating. Particles larger than about 0.25 inches are possible, with the upper limit on particle size being that size of particles which can be efficiently packed into the mold 30.

Where relatively large particle sizes of displacement material D have been used, dry powdered hard metal matrix material 14 may then be poured into the mold and around the displacement material. Where relatively small particles of displacement material have been used, it may be desirable to premix the displacement material and hard metal matrix material 14 prior to pouring the mixture into the mold 30.

It is desirable to vibrate the mold gently at this point of the process to insure that the matrix material 14 and displacement material particles D are completely packed and interspersed, that all voids have been filled, and that matrix material 14 has isolated particles of the displacement material from each other. This vibration encourages the formation of good bonds between binder, matrix, and displacement particles during heating.

In a preferred embodiment of the invention, the displacement material D replaces from about 50% to about 80% of the volume that the matrix material 14 would otherwise occupy. The use of different diameter displacement particles permits more efficient packing of the displacement material (the smaller particles occupy the interstices between larger particles) and a greater degree of displacement of the matrix material.

In some instances, displacement material D will be less dense than the binder 34 which infiltrates it. In such cases, it is preferred that a collar 32 of a dense metal such as tungsten be positioned as shown in FIG. 3 to contain the displacement material. Collar 32 may be formed by pouring a tungsten metal powder over displacement material D and matrix material 14.

Binder 34, preferably in the form of pellets or other small particles, is then poured over collar 32 and fills mold 30. The amount of binder 34 utilized should be calculated so that there is a slight excess of binder to completely fill all of the interstices between particles of displacement material and hard metal matrix material. Binder 34 is preferably a copper-based alloy as is conventional in the art.

The mold 30 is then placed in a furnace which is heated to above the melting point of binder 34, typically, about 1100 degrees C. The molten binder passes through powder collar 32 and completely infiltrates displacement material D, matrix material 14, and matrix material 14'. The materials are consolidated into a solid body which is bonded to steel blank 10. After cooling, the bit body is removed from the mold, and a portion of collar 32 is machined off. Steel blank 10 is then welded or otherwise secured to an upper body or shank such as companion pin which is then threaded to box 12 of the lower most drill collar at the end of drill string 13. Cutting elements 21 and 22, if not previously disposed in the mold, may be mounted at this time.

In an alternate embodiment of the invention, displacement material D is a metal powder such as iron, steel, or alloys thereof which completely replaces matrix material 14 in mold 30. In this alternate embodiment, matrix material 14' is required to provide an erosion resistant surface for the bit. Binder 34 infiltrates both the displacement material D and matrix material 14'. The powder size is 400 mesh or greater so that infiltration of the binder will occur without significant shrinkage of the metal powder. However, small amounts of less than 400 mesh size powder may be used to fill in interstices between the larger particles without encountering any sintering problems.

Somewhat surprisingly, it has been found that less expensive displacement material may be substituted for the more expensive hard metal matrix material and does not cause detrimental shrinkage in the mold. Additionally, when the preferred iron or steel displacement material is used, the resulting bit is tougher, less brittle, and more impact resistant than prior hard metal matrix drill bits.

In order that the invention may be more readily understood, reference is made to the following examples, which are intended to illustrate the invention, but are not to be taken as limiting the scope thereof.

EXAMPLE 1

As a comparison of the ductility of a bit body made by the practice of the present invention to a conventional hard metal matrix bit, a sample was prepared. The sample was a 1.25 inch diameter cylinder 2.5 inches in length. The sample was prepared in a graphite mold. Steel balls having a 0.25 inch diameter were placed in the mold, and a dry powder of tungsten carbide was poured over the balls. The balls were measured to displace approximately 66% of the volume in the mold which would otherwise have been occupied by the tungsten carbide powder.

Figure 4:
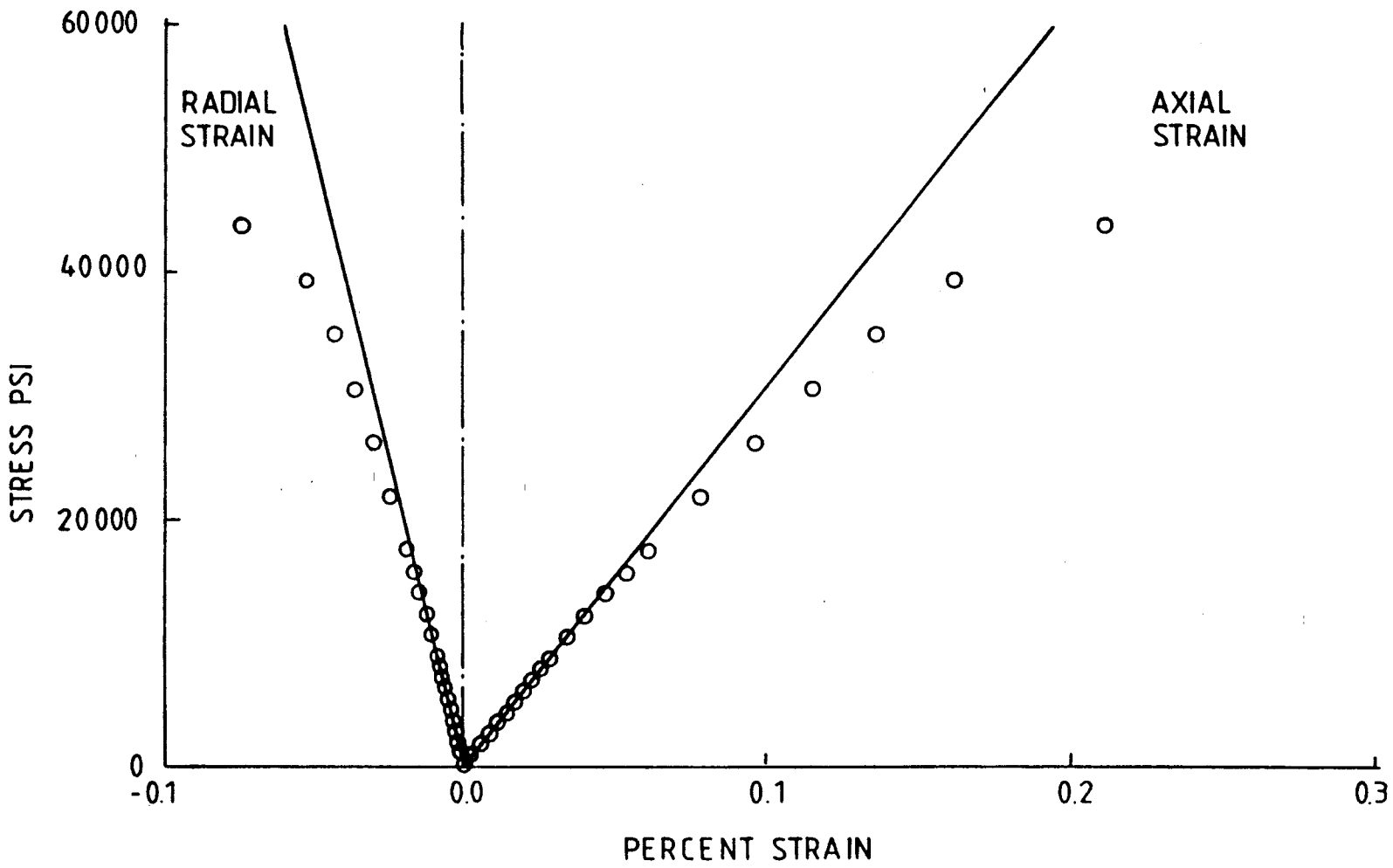
FIG. 4 is a stress versus strain curve for a bit body sample produced in accordance with the present invention.

A copper alloy binder, in the form of pellets, was placed in the mold over the balls and tungsten carbide. The sample was then heated in a furnace to melt the binder and cause it to infiltrate the matrix of balls and tungsten carbide. After cooling, the sample was tested on an Instron testing machine. Various loads were placed on the sample to develop the stress-strain curve illustrated in FIG. 4.

As shown by the graph, the modulus of elasticity of the sampler was measured to be $30.4\times10^6$. The modulus of elasticity is a measure of the stiffness of a material and is calculated from the slope of the stress-strain curve in the graph. The ultimate strength (load required to cause fracture) of the sample was measured to be $9.89\times10^4$ psi. Poisson's ratio was 0.29.

By comparison, a hard metal matrix sample fabricated using the same tungsten carbide powder and same copper alloy binder, but without the presence of any displacement material, has a modulus of elasticity of $15.0\times10^6$. Thus, a sample manufactured in accordance with the present invention has approximately twice the stiffness of a tungsten carbide matrix.

EXAMPLE 2

Samples were prepared to evaluate the impact strength of an infiltrated matrix in accordance with the present invention as compared to a hard metal matrix. Cylindrical specimens were prepared having a 0.5 inch diameter and a length of 2.25 inches. One sample was prepared using a tungsten carbide powder and a copper alloy binder. Another sample was prepared using an iron powder (50%, 48/70 mesh; 25%, 70 mesh; 25%, 150 mesh) and the same copper alloy binder. Both samples were heated in a furnace to melt the binder and permit it to infiltrate the respective metal powders. After cooling and solidification, the impact strength of each sample was tested. The tungsten carbide matrix had an impact strength 3.5 ft-lb. While the iron matrix made in accordance with the present invention had an impact strength greater than 25.0 ft-lb.

While certain representative embodiments and details have been shown for purposes of illustrating the invention, it will be apparent to those skilled in the art that various changes in the methods and apparatus disclosed herein may be made without departing from the scope of the invention, which is defined in the appended claims.

What is claimed is:

1. A rotary drill bit, comprising:

a bit body including a first plurality of particles substantially interspersed with a second plurality of particles and bonded together by a liquid binder infiltrated therethrough and subsequently solidified therebetween to form a matrix;

said first plurality of particles comprising a hard metal matrix material;

said second plurality of particles comprising a displacement material having a greater degree of toughness than said hard metal matrix material;

a plurality of cutting elements disposed on the exterior of said bit body;

a bit blank secured to said matrix and extending at least partly thereinto.

2. The drill bit of claim 1 wherein said displacement material particles comprise steel.

3. The drill bit of claim 1 wherein said displacement material particles comprise iron.

4. The drill bit of claim 1 wherein said displacement material particles are selected from the group consisting essentially of iron, steel, nickel, and alloys thereof, and mixtures thereof.

5. The rotary drill bit of claim 1 wherein said displacement material particles are generally spherical in shape.

6. The drill bit of claim 5 wherein said displacement material particles have diameters in the range of from about 0.001 to about 0.25 inches.

7. The drill bit of claim 5 wherein said displacement material comprises from about 50% to about 80% by volume of said matrix.

8. The drill bit of claim 5 wherein said displacement material particles are of a plurality of diameters.

9. The drill bit of claim 1 wherein said displacement material particles are substantially uniformly distributed throughout said matrix.

10. The rotary drill bit of claim 1, wherein said displacement material particles comprise from about 50% to about 80% by volume of said matrix.

11. A rotary drill bit, comprising:

a volume of particulate material, including:

a first plurality of tungsten carbide particles substantially interspersed with a second plurality of particles of a displacement material selected from the group consisting essentially of steel, iron, nickel, and alloys thereof, and mixtures thereof;

a steel bit blank at least partially extending into said volume of particulate material;

a copper alloy binder bonding said volume of particulate material together into a matrix and said matrix to said bit blank; and a plurality of cutting elements disposed on the exterior surface of said matrix.

12. The rotary drill bit of claim 11 wherein said displacement material particles are generally spherical in shape.

13. The rotary drill bit of claim 12 wherein said displacement material particles have a diameter in the range of from about 0.001 to about 0.25 inches.

14. The rotary drill bit of claim 11 wherein said displacement material particles are substantially uniformly distributed throughout said matrix.

15. The rotary drill bit of claim 11 wherein said displacement material particles comprise from about 50% to about 80% by volume of said matrix.

* * * * *